US011976409B2

(12) United States Patent
Graeser et al.

(10) Patent No.: US 11,976,409 B2
(45) Date of Patent: May 7, 2024

(54) DRYER AND METHOD FOR OPERATING A DRYER

(71) Applicant: LAVATEC LAUNDRY TECHNOLOGY GMBH, Heilbronn (DE)

(72) Inventors: Wolf-Peter Graeser, Flein (DE); Joachim Krause, Lautertal (DE)

(73) Assignee: LAVATEC LAUNDRY TECHNOLOGY GMBH, Heilbronn (DE)

( * ) Notice: Subject to any disclaimer, the term of this patent is extended or adjusted under 35 U.S.C. 154(b) by 756 days.

(21) Appl. No.: 17/050,675

(22) PCT Filed: Apr. 25, 2019

(86) PCT No.: PCT/DE2019/200033
§ 371 (c)(1),
(2) Date: Oct. 26, 2020

(87) PCT Pub. No.: WO2019/206383
PCT Pub. Date: Oct. 31, 2019

(65) Prior Publication Data

US 2021/0230792 A1 Jul. 29, 2021

(30) Foreign Application Priority Data

Apr. 27, 2018 (DE) ..... 102018206629.9

(51) Int. Cl.
*D06F 58/20* (2006.01)
*D06F 58/02* (2006.01)
(Continued)

(52) U.S. Cl.
CPC ..... *D06F 58/20* (2013.01); *D06F 58/26* (2013.01); *D06F 95/00* (2013.01); *D06F 58/02* (2013.01);
(Continued)

(58) Field of Classification Search
CPC ..... D06F 58/02; D06F 58/20; D06F 58/26; D06F 58/38; D06F 95/00; D06F 2105/48;
(Continued)

(56) References Cited

U.S. PATENT DOCUMENTS 2,399,555 A * 4/1946 Locke ..... D06F 58/02 34/131
3,768,173 A * 10/1973 Jessup ..... F26B 15/143 34/604
(Continued)

FOREIGN PATENT DOCUMENTS

DE 202015106435 2/2016
DE 102018206629 A1 * 10/2019 ..... D06F 58/02
(Continued)

*Primary Examiner* — Stephen M Gravini
(74) *Attorney, Agent, or Firm* — FisherBroyles, LLP; Jason P. Mueller

(57) ABSTRACT

A disclosed dryer includes a receptacle configured to contain material to be dried, an air duct configured to route recirculating air and/or fresh air to the receptacle, a heating device configured to heat the recirculating air, and at least one sensor. The sensor is configured to determine a relative humidity and/or temperature, and the air duct includes at least one adjusting element configured to modify a portion of recirculating air routed to the receptacle. The dryer further includes a control or regulating device configured to control or regulate the portion of recirculating air routed to the receptacle and/or a heating capacity of the heating device during a drying process. A disclosed method includes controlling a portion of recirculating air routed to the receptacle and/or a heating capacity of the heating device. Further, a mixture of recirculating air and fresh air are varied during heat-up, drying, and cool-down phases.

17 Claims, 6 Drawing Sheets

(51) Int. Cl.

| | |
|---|---|
| ***D06F 58/26*** | (2006.01) |
| ***D06F 58/38*** | (2020.01) |
| ***D06F 95/00*** | (2006.01) |
| ***D06F 103/02*** | (2020.01) |
| ***D06F 103/04*** | (2020.01) |
| ***D06F 103/06*** | (2020.01) |
| ***D06F 103/08*** | (2020.01) |
| ***D06F 103/12*** | (2020.01) |
| ***D06F 103/24*** | (2020.01) |
| ***D06F 103/32*** | (2020.01) |
| ***D06F 103/34*** | (2020.01) |
| ***D06F 103/36*** | (2020.01) |
| ***D06F 105/24*** | (2020.01) |
| ***D06F 105/28*** | (2020.01) |
| ***D06F 105/30*** | (2020.01) |
| ***D06F 105/32*** | (2020.01) |
| ***D06F 105/48*** | (2020.01) |

(52) U.S. Cl.
CPC ..... *D06F 58/38* (2020.02); *D06F 2103/02* (2020.02); *D06F 2103/04* (2020.02); *D06F 2103/06* (2020.02); *D06F 2103/08* (2020.02); *D06F 2103/12* (2020.02); *D06F 2103/24* (2020.02); *D06F 2103/32* (2020.02); *D06F 2103/34* (2020.02); *D06F 2103/36* (2020.02); *D06F 2105/24* (2020.02); *D06F 2105/28* (2020.02); *D06F 2105/30* (2020.02); *D06F 2105/32* (2020.02); *D06F 2105/48* (2020.02)

(58) Field of Classification Search
CPC ..... D06F 2105/32; D06F 2105/28; D06F 2105/30; D06F 2105/24; D06F 2103/08; D06F 2103/34; D06F 2103/32; D06F 2103/04; D06F 2103/12; D06F 2103/06; D06F 2103/02; D06F 2103/24; D06F 2103/36
USPC ..... 34/535, 595–610
See application file for complete search history.

(56) References Cited

U.S. PATENT DOCUMENTS

| | | | | | |
|---|---|---|---|---|---|
| 5,953,833 | A * | 9/1999 | Rudd | F26B 13/14 | 34/535 |
| 6,088,932 | A * | 7/2000 | Adamski | D06F 58/26 | 34/607 |
| 8,051,578 | B2 * | 11/2011 | Kohlrusch | F04D 29/666 | 416/241 A |
| 8,590,172 | B2 * | 11/2013 | Ahn | D06F 58/206 | 68/5 R |
| 8,627,581 | B2 * | 1/2014 | Brown | D06F 58/20 | 34/607 |
| 8,683,713 | B2 * | 4/2014 | Ha | D06F 58/24 | 68/19 |
| 10,612,183 | B2 * | 4/2020 | Graeser | D06F 31/005 | |
| 2015/0191863 | A1 * | 7/2015 | Kim | D06F 58/20 | 34/493 |
| 2016/0138208 | A1 * | 5/2016 | Bison | D06F 58/20 | 34/131 |
| 2019/0145043 | A1 * | 5/2019 | Beers | D06F 58/10 | 34/595 |
| 2021/0230792 | A1 * | 7/2021 | Graeser | D06F 58/20 | |

FOREIGN PATENT DOCUMENTS

| | | | | |
|---|---|---|---|---|
| EP | 0503586 | | 9/1992 | |
| EP | 3784830 | A1 * | 3/2021 | D06F 58/02 |
| KR | 20120015012 | | 2/2012 | |
| WO | 2016184462 | | 11/2016 | |
| WO | WO-2019206383 | A1 * | 10/2019 | D06F 58/02 |

* cited by examiner

DRYER AND METHOD FOR OPERATING A DRYER

This application is a national stage entry under 35 U.S.C. 371 of PCT Patent Application No. PCT/DE2019/200033, filed Apr. 25, 2019, which claims priority to German Patent Application No. 10 2018 206 629.9, filed Apr. 27, 2018, the entire contents of each of which is incorporated herein by reference.

This disclosure relates to a dryer with a receptacle for material to be dried, an air duct for routing recirculating air and/or fresh air to the receptacle, a heating mechanism, and at least one sensor for determining relative humidity and/or temperature, wherein the air duct includes at least one adjusting element such that the portion of recirculating air routed to the receptacle can be modified via the adjusting element. The disclosure further relates to a method for controlling or regulating a dryer according to the disclosure.

Dryers of the aforementioned type are known in the field and exist in various embodiments. To this end, reference is made to document WO 2016/184462 A1 only by example.

In general, after the washing process with mechanical drainage, the remaining water is removed from the textiles under the effect of heat. Depending on the type of laundry, pre-drying takes place in the drum dryer (tumbler) as preparation for ironing flat linen or for finishing shaped products. Certain portions (e.g. terry cloth fabrics) are subjected to complete drying. Pre-drying and complete drying differ in terms of the water content (residual moisture) of the laundry items at the end of drying. The residual moisture in the textiles (water content based on the dry laundry weight) is between 35% and 50% (pre-drying) and/or 5% and 0% (complete drying) depending on the type of laundry and subsequent treatment type. A significant problem with the removal of residual water under the effect of heat with the known dryers is the extremely unfavorable efficiency.

The desired residual moisture in the textiles determines the energy demand for drying over the necessary drying time for this and over the lifetime of the laundry items due to the textile damage caused by drying and thus the economic situation of laundries which are usually small and medium-sized businesses.

In order to heat the ventilation dryer currently being used in laundry businesses, the energy demand values are up to 1.5 kWh/kg of dried textile. This thermal energy demand, which is high compared to that theoretically required for evaporating the water, is due to the fact that the porous material to be dried is heated by hot air, which is routed to the textiles by a blower and simultaneously takes on the removal of the evaporated water. Due to the lower costs for installation, the easier regulation of the supply of thermal energy, and the less use of energy, directly gas-heated dryers have become more common as compared to steam-heated dryers. Electric heating is only still being used in washing machines for small businesses or for household devices.

The damage caused by drying may include textile damage such as changes in the textile dimensions, a reduction in the degree of whiteness and the color, as well as chemical damage to the fiber substrate. This damage to textiles may occur due to over-drying of the laundry items (removal of the water contained in textiles with typical air humidity, 10% for cotton) with increased temperature and drying time. Extended drying times—even at low temperatures—contribute to fiber abrasion due to intense "drying mechanics."

Thus, the object upon which the disclosure is based is to design and refine a dryer as well as a method for operating a dryer such that gentle drying is provided with the lowest-possible energy demand using simple design means.

According to the disclosure, said object is achieved by features recited in the claims. Accordingly, the dryer under discussion has a receptacle for material to be dried, an air duct for routing recirculating air and/or fresh air to the receptacle, a heating mechanism, and at least one sensor for determining relative humidity and/or temperature, wherein the air duct includes at least one adjusting element such that the portion of recirculating air routed to the receptacle can be modified via the adjusting element, such that a control or regulating mechanism is arranged such that the portion of recirculating air routed to the receptacle and/or the heating capacity of the heating mechanism can be controlled or regulated during the drying process.

In a manner according to the disclosure, it has initially become known that the drying process can be significantly optimized with respect to energy efficiency and textile care when the portion of recirculating air and/or the heating capacity can be regulated and/or controlled during operation. Specifically, the portion of recirculating air and/or the heating capacity of a control or regulating mechanism can be modified with consideration of the different drying phases, whereby it is achieved that the drying as a whole can be implemented with an extremely high degree of saturation of the process air and an air temperature which is as low as possible. Due to the design according to the disclosure, it is achieved, in addition to a high utilization of the heat quantity, that the drying process takes places in a manner extremely gentle to textiles, because over-heating of the material to be dried is prevented. Reference is made to the fact that the portion of recirculating air can be routed within the device—for example in a hood—and/or outside of the device—for example in pipes.

The term "fresh air" within the scope of this disclosure refers to ambient air which is routed to the dryer, for example the receptacle or the burner.

The term "process air" refers to air contained in the receptacle during the drying process. The term "exhaust air" refers to the air removed from the receptacle. If the exhaust air is routed back to the receptacle and thus forms a portion of the process air, it is referred to as "recirculating air."

The "material to be dried" may be textiles or even goods made of different materials, for example rubber mats or mats made of polyamide pile.

The "receptacle" may be formed as a drum with a single dryer. With a design having several devices, for example arranged behind or next to one another, the receptacle of the overall device may be formed, for example, by the respective drums of the devices, i.e. it may also be modular.

In an advantageous manner, the adjusting element may be a ventilation flap and/or a recirculating air blower. The ventilation flap in this case may be arranged in an air duct such that, in the open position of the air flap, exhaust air is routed back to the receptacle and is thus used as recirculating air. In an especially advantageous manner, the ventilation flap and optionally the air duct are configured such that a portion of recirculating air of 100% can be realized in a completely open position of the ventilation flap and a portion of recirculating air of 0% can be realized in a closed position of the ventilation flap. Alternatively or additionally, a recirculating air blower may be arranged in the air duct in order to supply exhaust air to the receptacle as recirculating air.

In order to provide an especially exact adjustment of the portion of recirculating air, it is conceivable that the position of the ventilation flap and/or the output for the recirculating air blower can be at least substantially infinitely adjustable. Due to this design measure, an especially energy-efficient control and/or regulation of the drying process is provided. Specifically, it is possible that the ventilation flap can be operated by a servomotor or a cylinder-piston mechanism (a pneumatic cylinder for example).

In a further advantageous manner, it is conceivable that the sensor is used for determining the relative exhaust air humidity of the exhaust air discharged from the input. This sensor may have a filter element in order to protect the sensor from lint. For example, a fabric filter and/or sintered steel element, for example, with a pore size of 5 μm, may be used as the filter element. At this juncture, reference is made to the extent that the term "relative exhaust air humidity" is to be understood in the broadest sense; the measurement of the relative humidity can take place inside the receptacle as well and thus relate to the process air. Alternatively or additionally, a sensor can be arranged for providing the surface temperature of the material to be dried. For example, this may be an infrared sensor or any other temperature sensor. It is also possible that a combined temperature and humidity sensor is provided. It is also conceivable that a sensor is arranged for determining the input air temperature and/or the output air temperature. The input air is air that is supplied to the receptacle, while the output air is the air which is discharged from the receptacle. Thus, any combination of the aforementioned sensors may be present. With a modular design, the number and functionality of the sensors of the individual devices may differ from one another such that the sensors are provided in accordance with the defined task of the devices. The input air temperature and/or the output air temperature can be considered during the control or regulation of the portion of recirculating air and/or the heating capacity.

According to an advantageous design, the regulation of the adjusting element, for example, of the position of the ventilation flap and/or of the recirculating air blower, takes place as a measured variable with the relative exhaust air humidity and/or with the surface temperature of the material to be dried and as a correcting variable with the portion of recirculating air. Such a design ensures that the portion of recirculating air can be varied based on the relevant, variable parameters during operation, whereby a significant improvement in the efficiency results and damage to the material to be dried is prevented.

Alternatively or additionally, it is further conceivable that the regulation of the heating mechanism takes place as a measured variable with the relative exhaust air humidity and/or the surface temperature of the material to be dried and as a correcting variable with the heating capacity. Thus, the heating capacity of the burner can be varied based on the various parameters which change during the drying process.

In a further advantageous manner, the receptacle may have several devices arranged one after the other and/or next to one another which are configured in a suitable manner for heating, drying, or cooling of the material to be dried; for example, each device may have its own heating mechanism. In this case, the receptacle may have two or more devices arranged one after the other and/or next one another. This offers the option of implementing individual process stages in an especially efficient manner, wherein the portion of recirculating air and/or the heating capacity of the heating mechanism of each device can be controlled during the drying process. For example, a configuration with one device for heating, one or more devices for drying, one device for controlling the moisture content of the material to be dried, and one device for cooling the material to be dried is especially efficient. Furthermore, the dryer may have at least one transport mechanism assigned to a device for further transport of the material to be dried from this device to another device. Such type of transport mechanism provides secure transport and/or secure circulation of the material to be dried in the drying process effected by the devices.

In one advantageous exemplary embodiment, the air duct may be configured such that it is recirculating air supplied to a device, exhaust air of this device, and/or exhaust air of at least one other device. For example, it may be the exhaust air of a device arranged in front, when considered in the transport direction of the material to be dried, for example, of the device arranged directly in front, or several devices arranged in front. Due to the at least partial use of exhaust air as recirculating air, the heat contained in the exhaust air can be used with one or more other devices. As an alternative or in addition to such type of utilization of the exhaust air as infeed air or recirculating air, the exhaust air may also be used as combustion air of the heating mechanism, provided the heating mechanism is operated by a combustion process. In addition to such an operating method of the heating mechanism, heating of the air can also take place by steam or electrical energy—without a combustion process. In this case, the exhaust air of a device is not needed for the heating mechanism.

As an alternative or in addition to a use of the exhaust air of a device or of several devices as previously described, heat from the exhaust air of one device or several devices can be transferred, in a further advantageous manner, at least partially to infeed air and/or recirculating air of a device, which is arranged in front, for example, arranged directly in front, or several devices, which are arranged in front. Such type of transfer process can take place by one or more heat exchangers, for example, air/air heat exchangers. This type of use of exhaust heat from exhaust air differs from a direct transfer of heat due to a transfer means used—of the heat exchanger—as is the case, for example, when exhaust air of a device at least partially forms the infeed air of one or more other devices. A heat exchanger may be integrated, for example, into a device or may be assigned directly to a device in order, for example, to provide recirculating air operation of the device. As an alternative or in addition to this, one heat exchanger or several heat exchangers may be provided which are arranged in an air duct or integrated into an air duct in order to preheat, for example, infeed air for a device, if necessary, by the exhaust air of a device.

In order to ensure an especially good drying result and to reliably ensure efficient use of the required energy, a device for controlling the moisture content of the material to be dried may be arranged upstream of a device for cooling the material to be dried. Such type of control device may form the end of an arrangement of devices for heating and for drying in order to control the moisture content before cooling of the material to be dried and optionally in order to additionally carry out post-drying in the control device.

With respect to an especially efficient use of the required energy, the infeed air of a device for controlling the moisture content of the material to be dried may be at least partially air which is heated by a heat exchanger, for example, by an air/air heat exchanger, which itself draws thermal energy from the exhaust air of a device for heating the material to be dried and/or from the exhaust air of another device or of the device for controlling the moisture content of the material to be dried. In this case, there is efficient use of energy due to the supply of preheated infeed air. In an especially advantageous manner, the infeed air to this control device is formed exclusively by air preheated in the aforementioned manner.

Infeed air and/or fresh air can be supplied, from the installation space in which this device or the devices are arranged, to one or more devices of an arranged device, typically as an end of the arrangement, for cooling the material to be dried, or it can be supplied from outside of the building.

In a further advantageous manner, it is conceivable that the air duct, which may be formed, for example, at least partially from corresponding pipes, has additional blowers and/or fans. It is thereby possible to support the flow of air such that a reliable functionality of the dryer is ensured, for example, with air ducts over large distances.

In an especially advantageous embodiment, a transport mechanism may be arranged between every two devices. In this case, the transport mechanism may have a conveyor belt or a chute or chute channel. In the case of a chute or chute channel, a suitable height offset is practicable between the devices so that the material to be dried is transported from one device to the next device with gravity. Optionally, a pressurized air support may be provided which ensures secure further transport of the material to be dried. As an alternative to the aforementioned embodiments, the transport mechanism may be formed as an internal mechanical system of a device or may be integrated into a device. Such type of transport mechanism or mechanical system can move the material to be transported between devices by suitable gripping and/or guide elements. The quantity of material to be dried which is necessary to be transported can be considered during the selection of a suitable transport mechanism.

With respect to a secure supply of the material to be dried to the receptacle, an infeed mechanism for the material to be dried can be arranged upstream of the receptacle, said infeed mechanism having a weighing device for the material to be dried. This ensures that the dryer and specifically the receptacle are loaded with a suitable quantity of material to be dried. Overloading of the dryer can hereby be prevented.

To further optimize the drying process, it is possible that the control or regulating mechanism considers the material to be dried (type of material to be dried), the heater temperature, the residual moisture of the material to be dried, the starting moisture of the material to be dried, the load quantity, the filling ratio, the process air state variables, the blower capacity (of a recirculating air blower and/or of a heater blower), the drum movement, and/or the burner temperature as further parameters. For example, the user can specify that the material to be dried is rubber mats or mats made of polyamide pile of a certain load quantity. Corresponding parameters can be input, for example via an input mechanism, and considered by the control or regulating mechanism. In other words, the user can select a specific program for a material to be dried in order to implement the drying process. It is also conceivable that the adjusting element or the adjusting elements are controllable as a function of the pressure prevailing in the air duct. To this end, one or more air pressure sensors can be arranged.

The fundamental object is achieved by disclosed methods. Accordingly, a method is disclosed for operating a dryer having a receptacle for material to be dried, an air duct for routing recirculating air and/or fresh air to the receptacle, a heating mechanism, and at least one sensor for determining relative humidity and/or temperature, wherein the air duct includes at least one adjusting element such that the portion of recirculating air routed to the receptacle is modified via the adjusting element, such that a portion of the recirculating air routed to the receptacle and/or the heating capacity of the heating mechanism is controlled or regulated via a control or regulating mechanism during the drying process.

In a manner according to the disclosure, it has been recognized in this case that a significant improvement is achievable in the efficiency in that the portion of recirculating air and/or the heating capacity can be varied during the drying process.

In an advantageous manner, a high portion of recirculating air, for example, between 90% and 100% recirculating air, and a low portion of fresh air, for example, between 0% and 10% fresh air, are routed to the receptacle during a heat-up phase. Alternatively or additionally, the portion of recirculating air is reduced during a drying phase as a function of the measured relative exhaust air humidity, and/or the heating capacity of the heating mechanism is reduced. It is further possible that a low portion of recirculating air, for example, of from 0% to 10%, and a high portion of fresh air, for example, of from 90% to 100%, are routed to the receptacle during a cool-down phase. If the receptacle has several devices, it is possible that one or more devices implement only the heat-up phase or the drying phase or the cool-down phase of the drying process.

With respect to gentle and efficient drying, it may be provided that the duration of the drying phase and/or the reduction in the portion of recirculating air is varied during the drying phase with consideration of at least one external parameter. The type of material to be dried, the heater temperature, the residual moisture of the material to be dried, the starting moisture of the material to be dried, the load quantity, the filling ratio, the process air state variables, the blower capacity (of a recirculating air blower and/or of a heater blower), the drum movement, and/or the burner temperature serve as external parameters.

There are then various options for designing and refining the teaching of the disclosure in an advantageous manner. To this end, reference is made, on one hand, to claims referring back to claims 1 and 12, and, on the other hand, to the subsequent explanation of exemplary embodiments of the disclosure by the drawings. In conjunction with the explanation of the exemplary embodiments of the disclosure by the drawings illustrate embodiments and refinements of the teaching are also generally explained. The drawings show the following:

Figure 1:
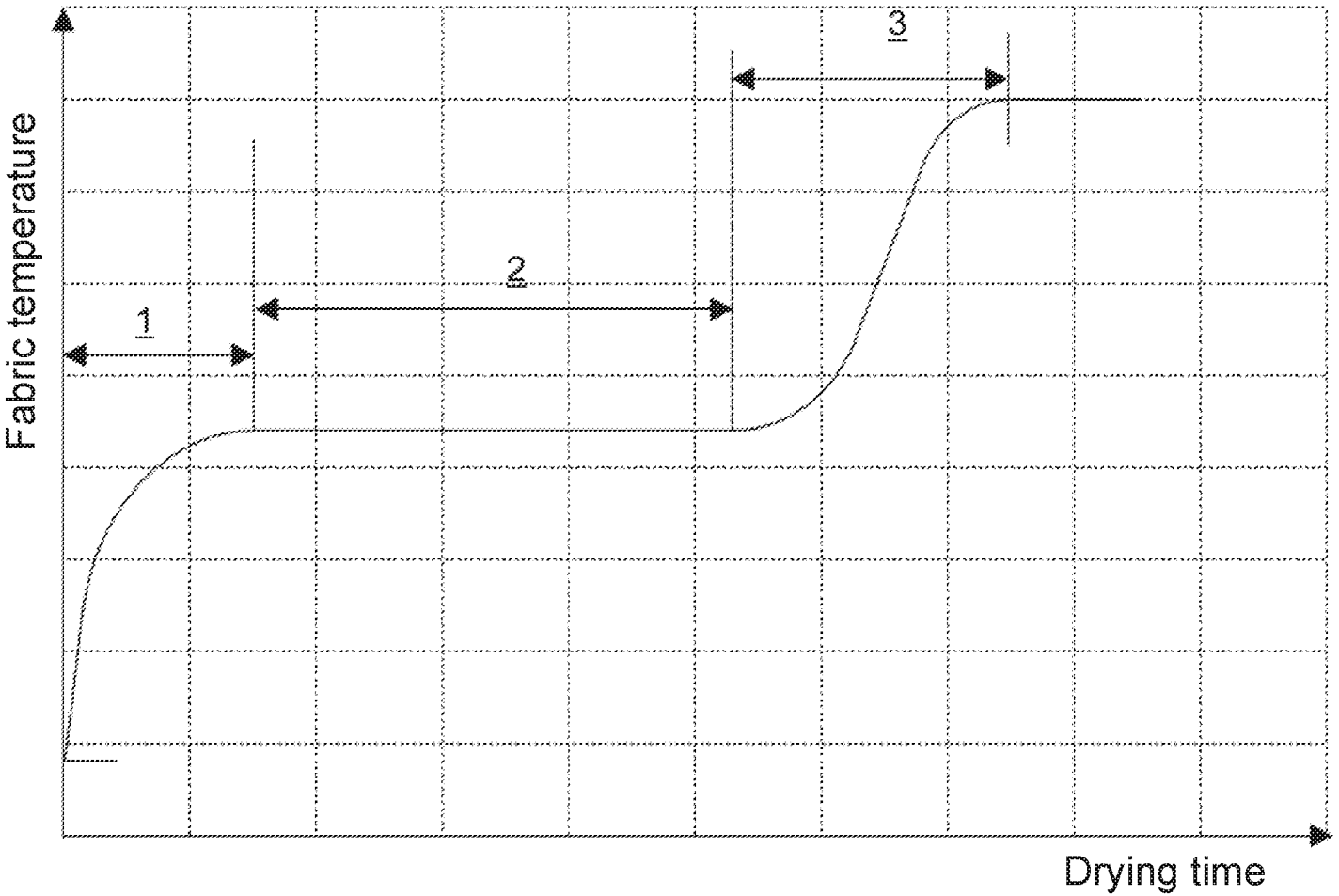
FIG. 1 shows the typical curve of the fabric temperature as a function of the drying time during a drying process.

FIG. 1 shows the typically chronological temperature curve in the material to be dried for the duration of the drying, wherein the fabric temperature is applied as a function of the drying time. The three phases 1, 2, 3 of the drying process can be seen. In the first phase 1, the temperature quickly increases to the value of the evaporation temperature (cooling limit temperature) in order to subsequently keep this temperature constant over the course of the second phase 2 as long as the moisture is being evaporated from the surface of the textile. In the third phase 3, the residual moisture is evaporated from the capillaries of the textiles, which leads to a strong increase in the temperature up to the level of hot air. This phase indicates that the drying process has ended, the supply of heat is stopped, and the cool-down can be initiated.

Figure 2:
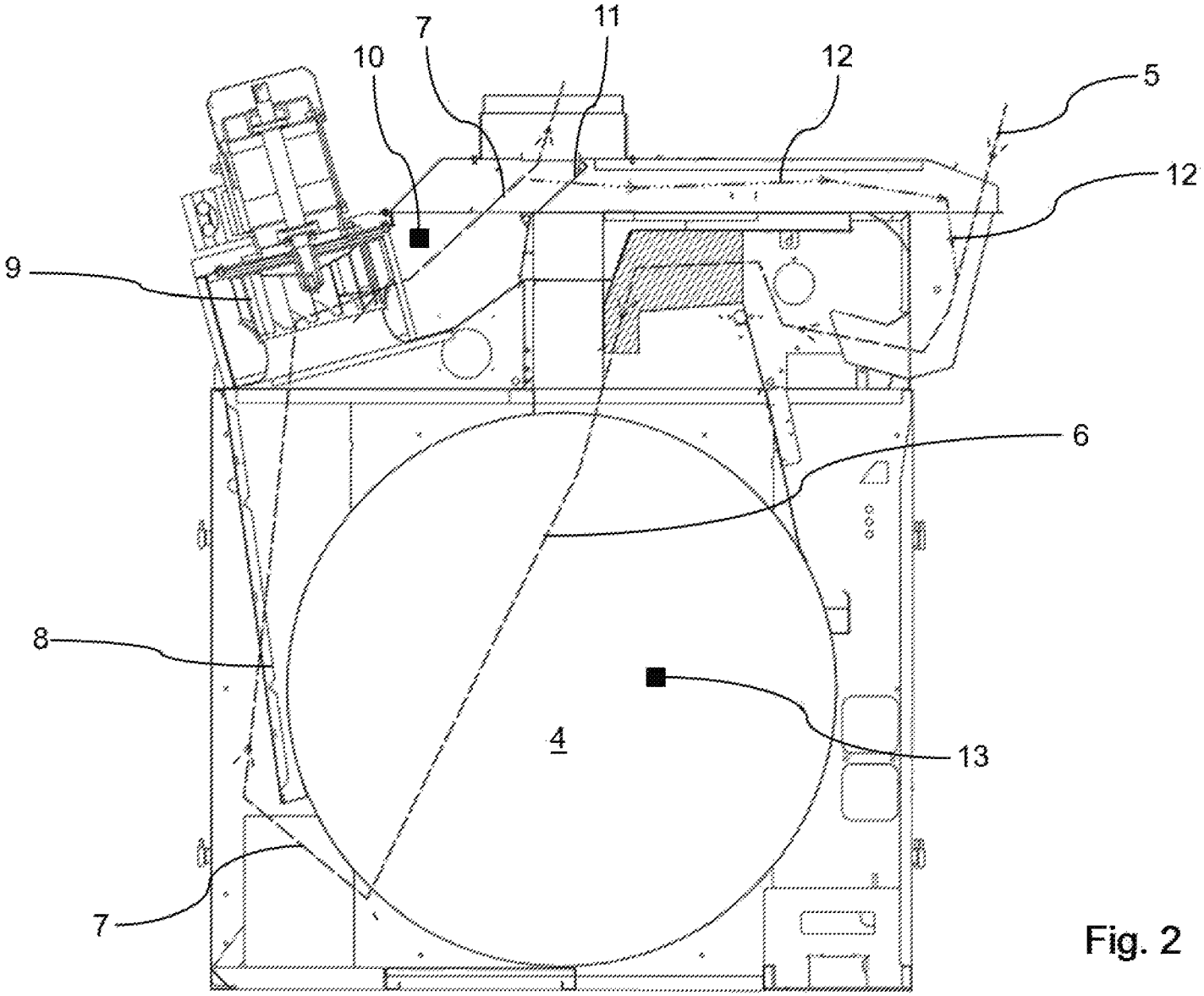
FIG. 2 shows a schematic, sectional view of a first exemplary embodiment of a dryer according to the disclosure for implementing the method according to the disclosure.
Figure 3:
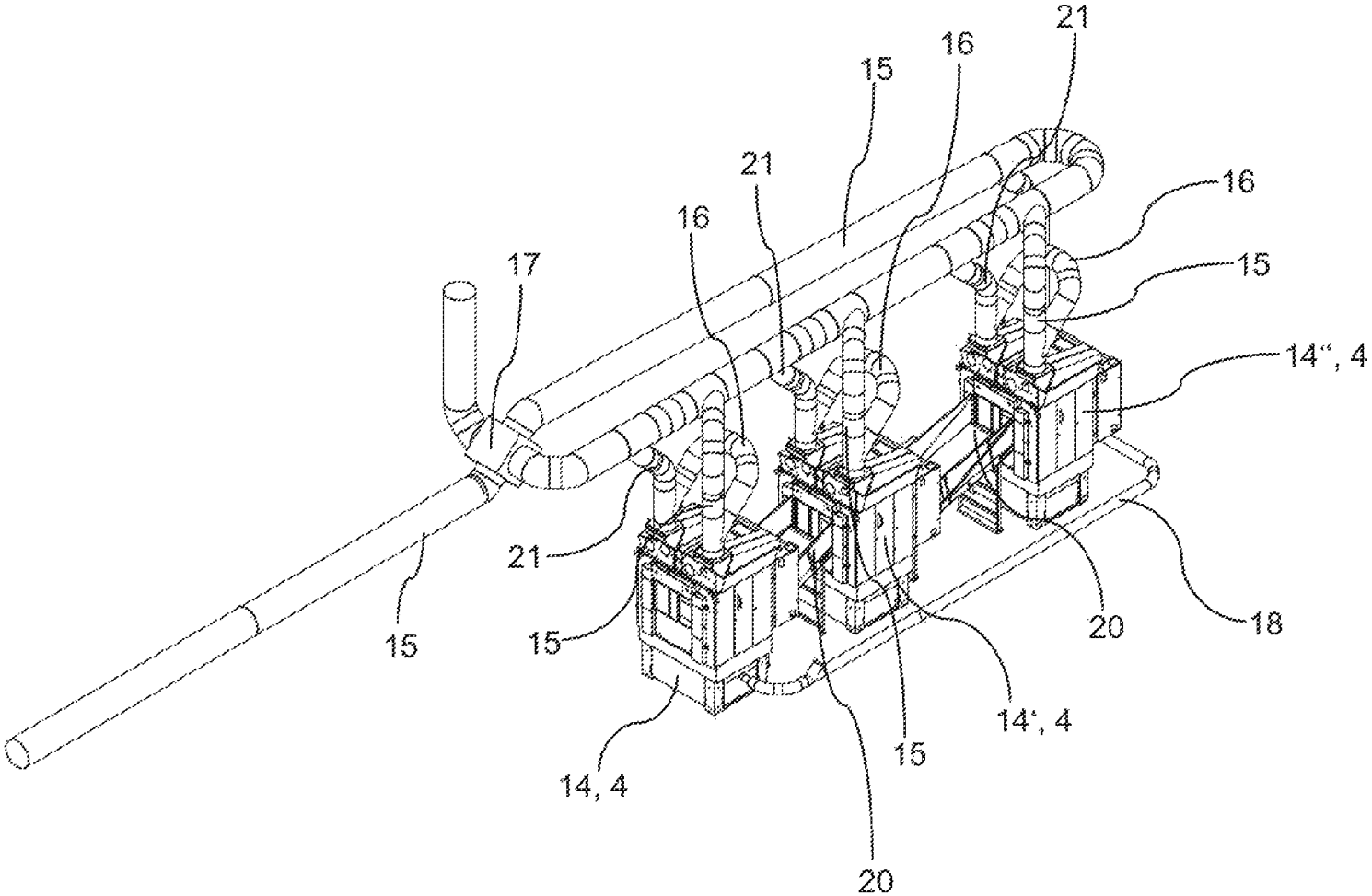
FIG. 3 shows a schematic, perspective view of a second exemplary embodiment of a dryer according to the disclosure for implementing the method according to the disclosure.
Figure 4:
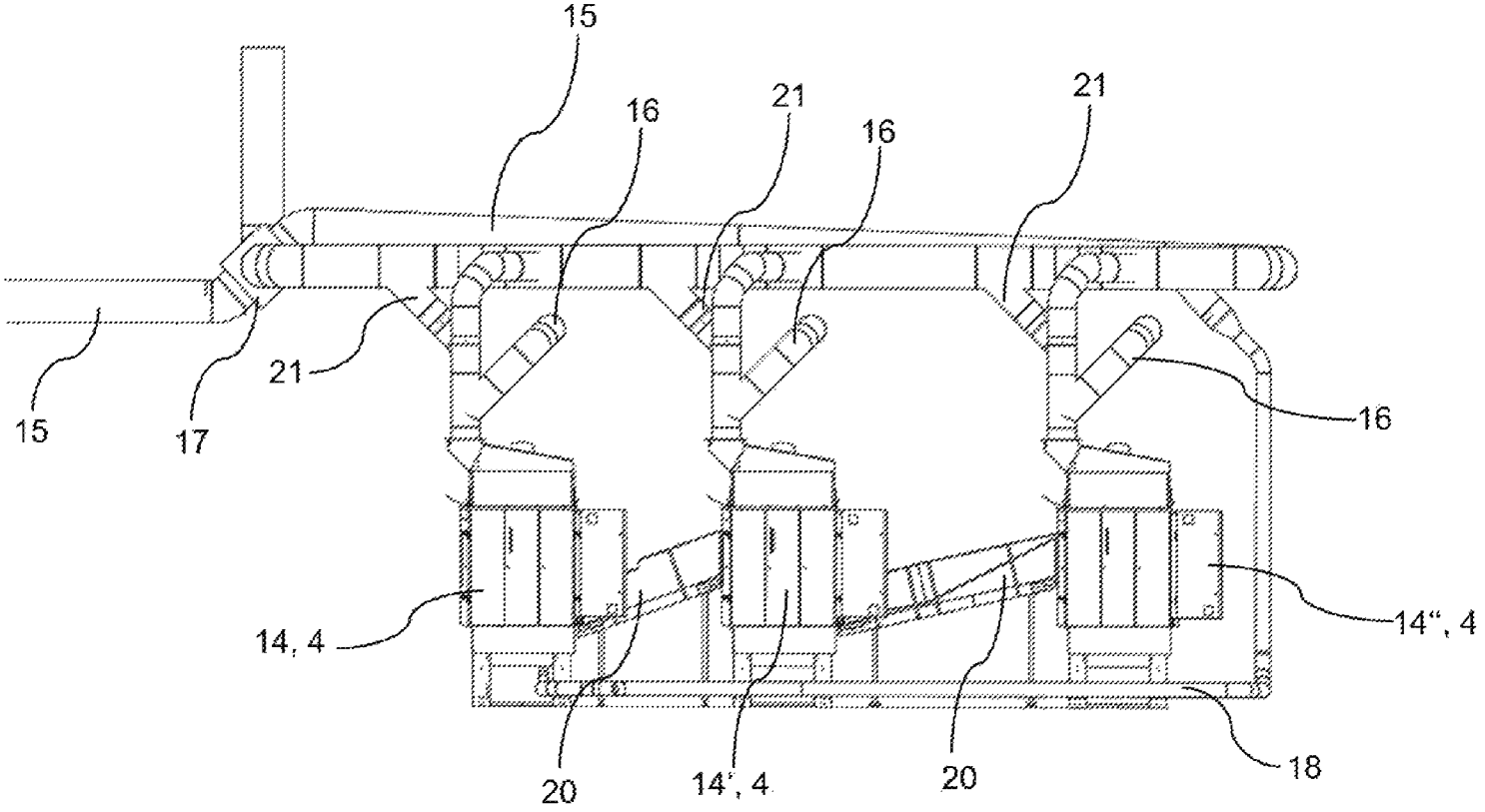
FIG. 4 shows a schematic, lateral view of the exemplary embodiment according to FIG. 3.
Figure 5:
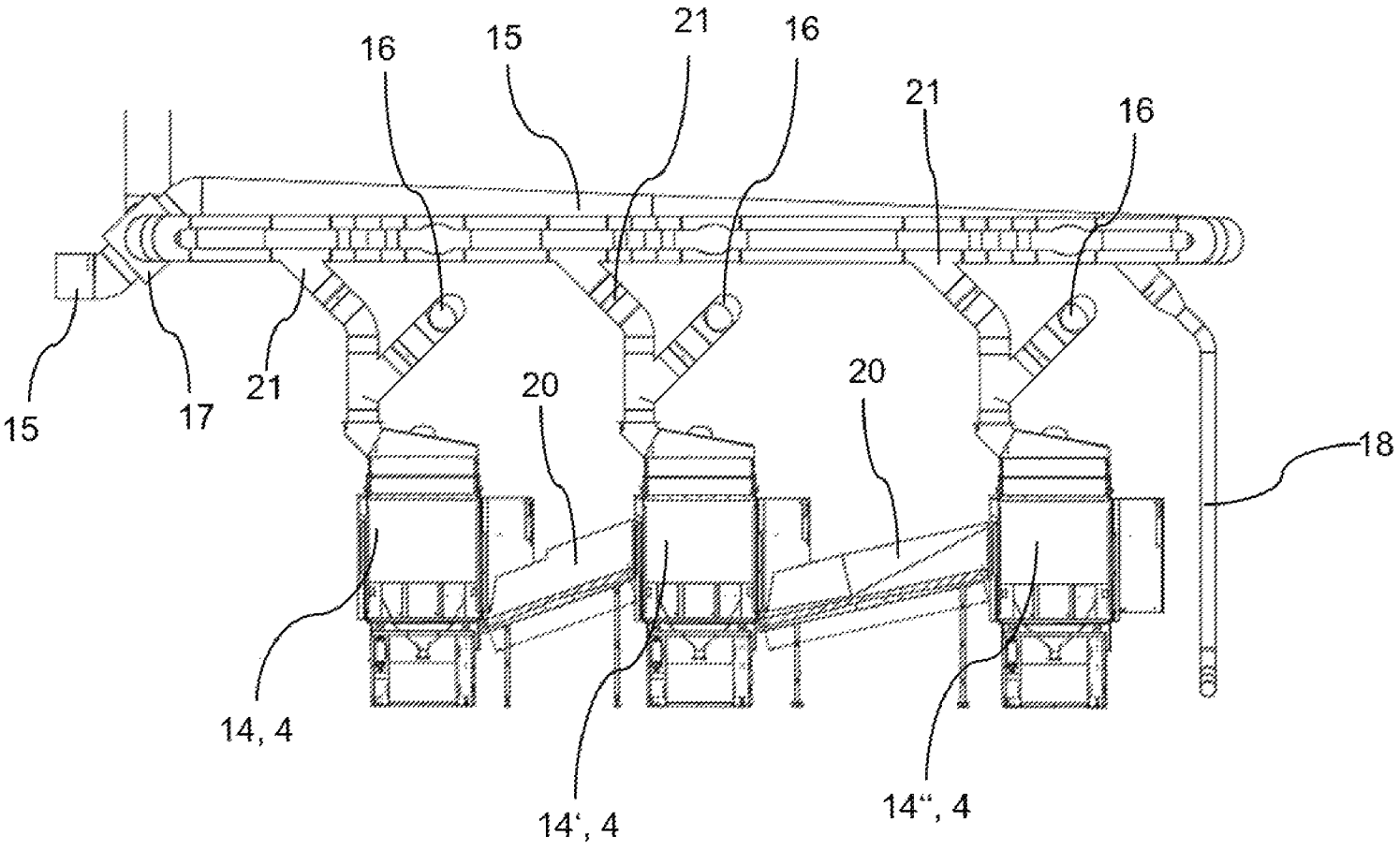
FIG. 5 shows a schematic, lateral, and partially sectional view of the exemplary embodiment according to FIG. 3.
Figure 6:
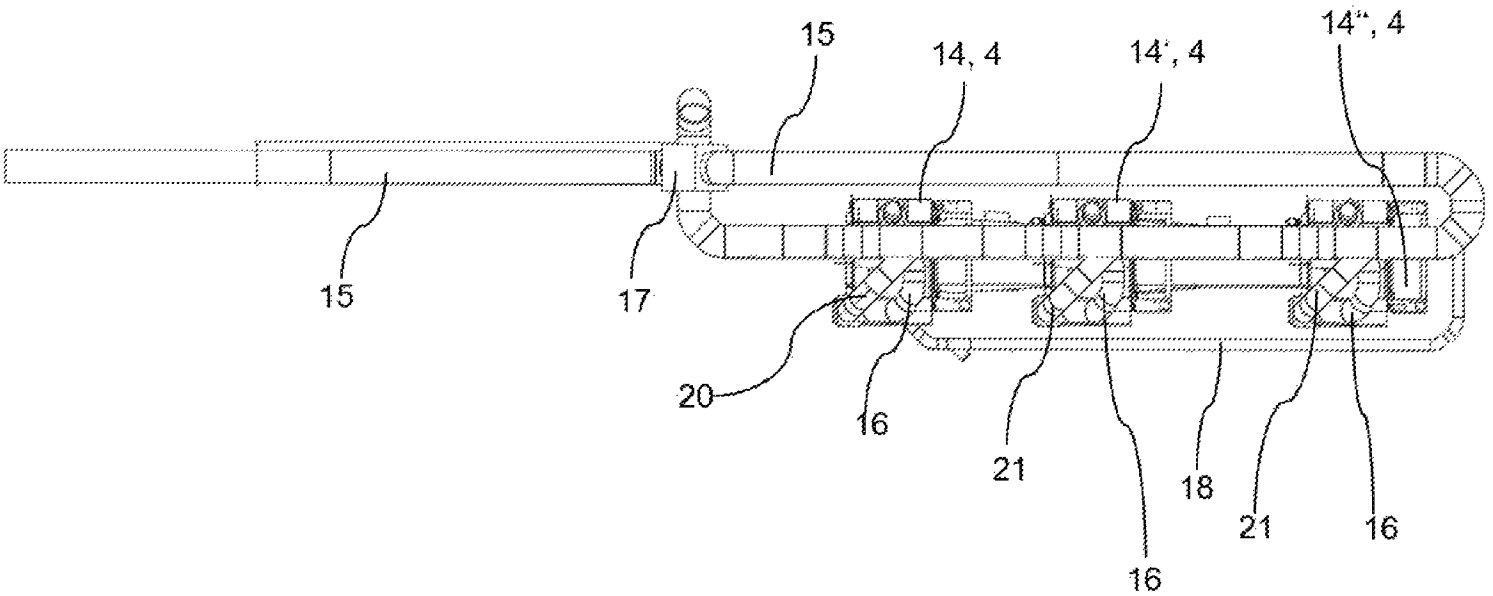
FIG. 6 shows a schematic, top view of the exemplary embodiment according to FIG. 3.

FIG. 2 shows a first exemplary embodiment of a dryer according to the disclosure. The dryer is formed as a single dryer and has a receptacle 4 for the material to be dried, which is not shown. The receptacle 4 can be formed as a drum in this case. Fresh air 5 can be supplied to the receptacle 4 from outside of the device, which is guided transversely through the receptacle 4 and removes moisture there from the material to be dried as process air 6. The exhaust air 7 discharged from the receptacle passes through a lint filter 8. When viewed in the direction of flow of the exhaust air 7, a recirculating air blower 9 as well as a moisture sensor 10 are arranged downstream of the lint filter 8. This arrangement prevents the moisture sensor 10 from becoming full of lint However, it is also possible to arrange the moisture sensor 10 upstream of the lint filter 8, as viewed in the direction of flow.

Furthermore, a ventilation flap 11 is shown in FIG. 2. If the air flap 11 is closed, the exhaust air 7 is routed out of the dryer. If the air flap 11 is completely or partially open, the exhaust air 7 can be supplied, wholly or partially, to the receptacle 4 as recirculating air 12.

With the device shown in FIG. 2, which is suitable for executing the method according to the disclosure, the position of the air flap 11 and/or the capacity of the recirculating air blower 9 can be varied during operation as a function of the humidity of the exhaust air 7 measured with the moisture sensor 10. Furthermore, it is conceivable that a temperature sensor 13, which is used to determine the surface temperature of the material to be dried, is arranged in the receptacle 4. A sensor can also be provided for determining the input air temperature and/or a sensor for determining the output air temperature.

FIGS. 3 to 6 show, in various schematic views, a further exemplary embodiment of a device according to the disclosure, which is suitable for implementing a method according to the disclosure. In this exemplary embodiment, the receptacle 4 is formed by several devices 14, 14', 14", arranged after one another, for example for heating, drying, or cooling of the material to be dried. The individual devices 14, 14', 14" in this case may be formed according to the exemplary embodiment shown in FIG. 2 to the extent that reference is made to the related designs. With such an embodiment, the receptacle 4 of the entire device can be formed by the individual receptacles and/or drums of the devices 14, 14', 14".

Furthermore, FIGS. 3 to 6 show that fresh air can be supplied to the individual devices via a fresh air duct 15. Furthermore, each device has a recirculating air duct 16, by which recirculating air can be supplied to the receptacle 4, i.e. to each device 14, 14', 14", in that specifically the adjusting elements, which are not shown, are regulated and/or controlled. The exhaust air of the respective device 14, 14', 14" can be dissipated via an exhaust air duct 21.

Furthermore, a heat exchanger 17 is arranged, by which the heat from the exhaust air can be transferred to the infeed air.

In order to further improve the energy efficiency, the first device 14 has a hot air supply 18, by which the heating mechanism 19 can be supplied with fresh air, which can be preheated via the heat exchanger 17. In this case, it is conceivable that all devices 14, 14', 14" have a corresponding hot air supply 18.

An infeed for the material to be dried is arranged upstream of the first device 14, the device 14 being loaded with the material to be dried via said infeed. A transport mechanism 20, for further transport of the material to be dried, is arranged between device 14 and device 14', as well as between device 14' and device 14".

Due to the modular design of the device, the material to be dried can be heated, for example, in the first device 14, i.e. the heat-up phase takes place in this device 14. The actual drying of the material to be dried takes place in the second device 14', i.e. the drying phase takes place in this device 14'. The cooling of the material to be dried, for example, can take place in the last device 14", i.e. the cool-down phase takes place. The portion of recirculating air supplied to the individual devices 14, 14', and 14" can occur during the drying process as a function of the measured air humidity and/or surface temperature of the material to be dried. Alternatively or additionally, the heating capacity of the heating mechanisms of devices 14, 14', and 14" can be varied as a function of these measured values.

With regard to other advantageous embodiments of the device according to the disclosure and of the method according to the disclosure, to avoid repetition, reference is made to the general part of the description and also to the accompanying claims.

Finally, it is expressly pointed out that the above-described exemplary embodiments of the device according to the disclosure and of the method according to the disclosure serve only to explain the claimed teaching, but do not restrict it to the exemplary embodiments.

LIST OF REFERENCE NUMERALS

1 First phase
2 Second phase
3 Third phase
4 Receptacle
5 Fresh air
6 Process air
7 Exhaust air
8 Lint filter
9 Recirculating air blower
10 Moisture sensor
11 Ventilation flap
12 Recirculating air
13 Temperature sensor
14, 14', 14" Device
15 Fresh air infeed
16 Recirculating air infeed
17 Heat exchanger
18 Hot air infeed
19 Heating mechanism
20 Transport mechanism
21 Exhaust air duct

The invention claimed is:

1. A dryer comprising:

a receptacle configured to contain material to be dried;

an air duct configured to route recirculating air and/or fresh air to the receptacle;

a heating device configured to heat the recirculating air;

at least one sensor configured to determine a relative humidity and/or temperature, wherein the air duct comprises at least one adjusting element configured to modify a portion of recirculating air routed to the receptacle; and a control or regulating device configured to control or regulate the portion of recirculating air routed to the receptacle and/or a heating capacity of the heating device during a drying process, wherein the control or regulating device is further configured to control the adjusting element to:

route, during a heat-up phase, a first portion of recirculating air and a second portion of fresh air to the receptacle, wherein the first portion is a high portion and the second portion is a low portion;

route, during a cool-down phase, the first portion of recirculating air and the second portion of fresh air to the receptacle, wherein the first portion is a low portion and the second portion is a high portion;

reduce, during a drying phase, the first portion of recirculating air, based on a measured relative exhaust air humidity and/or based on a heating capacity of the heating device.

2. The dryer according to claim 1, wherein the adjusting element comprises a ventilation flap and/or a recirculating air blower.

3. The dryer according to claim 2, wherein a position of the ventilation flap and/or an output of the recirculating air blower is continuously adjustable.

4. The dryer according to claim 1, wherein the sensor is configured to determine a relative humidity of exhaust air discharged from the receptacle.

5. The dryer according to claim 1, wherein the sensor is configured to determine a surface temperature of the material to be dried and/or to determine an input air temperature and/or an output air temperature.

6. The dryer according to claim 4, wherein the control or regulating device controls the adjusting element to adjust the portion of recirculating air based on a determined relative exhaust air humidity.

7. The dryer according to claim 5, wherein the control or regulating device controls the adjusting element to adjust the portion of recirculating air based on a determined surface temperature of the material to be dried.

8. The dryer according to claim 4, wherein the control or regulating device controls the heating capacity of the heating device based on a determined relative exhaust air humidity.

9. The dryer according to claim 1, wherein the receptacle further comprises:

a heating device configured to heat the material to be dried;

a drying device configured to dry the material to be dried;

a cooling device configured to cool the material to be dried; and a transport device configured to transport the material to be dried between at least at least a first and a second one of the heating device, the drying device, and the cooling device, wherein the heating device, the drying device, and the cooling device are positioned one after another along a direction in which material to be dried is transported.

10. The dryer according to claim 9, wherein the air duct is configured to provide the recirculating air as exhaust air from at least a first one to a second one of the heating device, the drying device, and the cooling device.

11. The dryer according to claim 2, wherein the receptacle is configured as a rotating drum, and wherein the control or regulating device controls or regulates the portion of recirculating air routed to the receptacle and/or the heating capacity of the heating device based on one or more parameters, the parameters including:

a type of material to be dried;

a heater temperature;

a residual moisture of the material to be dried;

a starting moisture of the material to be dried;

a load quantity of material to be dried;

a filling ratio of the receptacle;

an air temperature or relative humidity;

a blower capacity; and a motion of the rotating drum.

12. A method of operating a dryer, the dryer comprising a receptacle configured to contain a material to be dried, an air duct configured to route recirculating air and/or fresh air to the receptacle, a heating device configured to heat the recirculating air, a control or regulating device, and at least one sensor configured to determine relative humidity and/or temperature, wherein the air duct comprises at least one adjusting element configured to modify a portion of recirculating air routed to the receptacle, the method comprising:

controlling during a drying process, via the control or regulating device, a portion of recirculating air routed to the receptacle and/or a heating capacity of the heating device, wherein controlling includes:

routing, during a heat-up phase, a first portion of recirculating air and a second portion of fresh air to the receptacle, wherein the first portion is a high portion and the second portion is a low portion;

routing, during a cool-down phase, the first portion of recirculating air and the second portion of fresh air to the receptacle, wherein the first portion is a low portion and the second portion is a high portion;

measuring a relative exhaust air humidity;

reducing, during a drying phase, the first portion of recirculating air, based on a measured relative exhaust air humidity and/or based on a heating capacity of the heating device.

13. The method according to claim 12, further comprising:

wherein during the heat-up phase the first portion of recirculating air includes 90% to 100% recirculating air, and the second portion of fresh air includes 0% to 10% fresh air.

14. The method according to claim 12, wherein during the cool-down phase the first portion of recirculating air includes 0% to 10% recirculating air, and the second portion of fresh air includes 90% to 100% fresh air.

15. The method according to claim 12, further comprising:

controlling a duration of the drying phase and/or the reduction in the first portion of recirculating air based on at least one external parameter.

16. The method according to claim 15, wherein the receptacle is configured as a rotating drum, and wherein the at least one external parameter is chosen from parameters including:

a type of material to be dried;

a heater temperature;

a residual moisture of the material to be dried;

a starting moisture of the material to be dried;

a load quantity of material to be dried;

a filling ratio of the receptacle;

an air temperature or relative humidity;

a blower capacity; and a motion of the rotating drum.

17. The dryer according to claim 5, wherein the control or regulating device controls the heating capacity of the heating device based on a determined surface temperature of the material to be dried.

* * * * *